United States Patent [19]

Sakata

[11] 3,983,520

[45] Sept. 28, 1976

[54] SOLENOID ELECTROMAGNET HAVING A WIDE, CONTROLLED STROKE

[76] Inventor: Denjiro Sakata, N. 6-11, Muromachi, Ikeda, Osaka, Japan

[22] Filed: Oct. 1, 1975

[21] Appl. No.: 618,678

[30] Foreign Application Priority Data

Oct. 4, 1974 Japan ..... 49-115979

[52] U.S. Cl. ..... 335/170; 335/239; 335/253

[51] Int. Cl.[2] ..... H01H 9/20

[58] Field of Search ..... 335/169, 170, 171, 253, 335/239, 254, 240

[56] References Cited

UNITED STATES PATENTS

| | | | |
|---|---|---|---|
| 3,307,131 | 2/1967 | Hook et al. | 335/253 |
| 3,893,053 | 7/1975 | Onatsevich | 335/254 |

FOREIGN PATENTS OR APPLICATIONS

| | | | |
|---|---|---|---|
| 1,053,771 | 8/1958 | Germany | 335/253 |

*Primary Examiner*—George Harris
*Attorney, Agent, or Firm*—Wenderoth, Lind & Ponack

[57] ABSTRACT

A solenoid electromagnet includes a movable core spaced from a fixed core, a spring urging the movable core away from the fixed core, an operation rod having a plurality of detent projections, a picker having an axially fixed connection with the movable core, and a catch having an axially fixed connection with the fixed core. The operation rod is slidably inserted in the movable core, and the picker as well as the catch is engageable with the detent projections of the rod. The stroke of the movable core causes the picker to push the operation rod by the engagement of the picker with the detent projection. At the same time the catch engages the detent projection to hold the operation rod at its position, thereby enabling successive advancement of the operation rod according to the strokes of the movable core.

5 Claims, 7 Drawing Figures

SOLENOID ELECTROMAGNET HAVING A WIDE, CONTROLLED STROKE

The present invention relates to solenoid electromagnets, and more particularly to a solenoid electromagnet having a wide and controlled stroke.

Though a conventional solenoid electromagnet has an advantage in that it can be readily controlled by means of a simple peripheral control devices, it is of no practical use with an exception of short stroke operation since the stroke of the moving core is much shorter than that of a pneumatic cylinder or a motor cylinder.

An object of the present invention is to obviate the above defect, and to provide a solenoid electromagnet having a long stroke which can be exactly and minutely controlled.

Further objects and features of the invention will be apparent from the following description of the invention with reference to the accompanying drawings, in which.

Throughout the drawings similar parts and elements are shown by the similar reference numerals.

Figure 1:
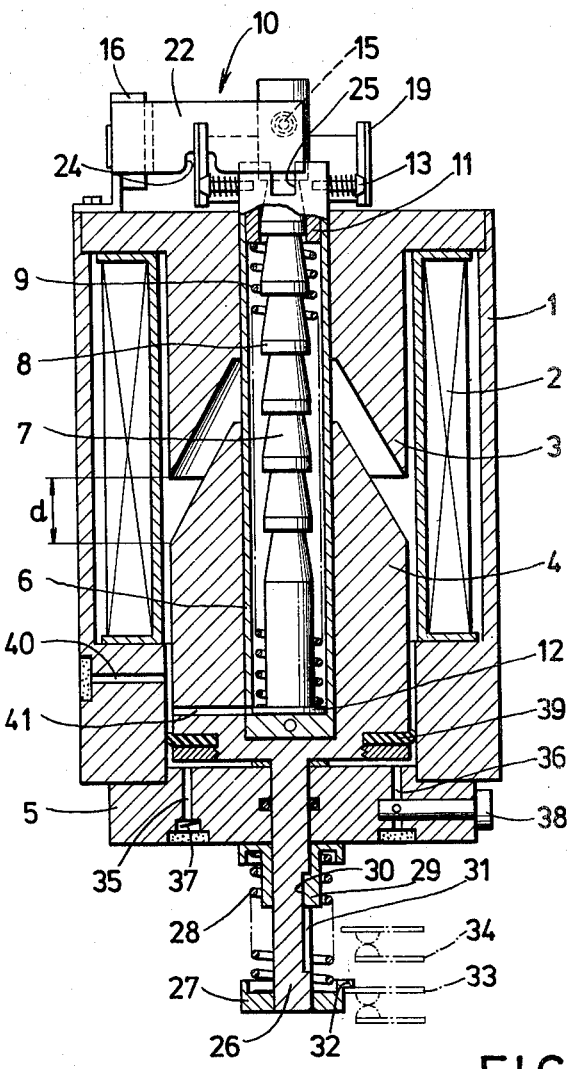
FIG. 1 is a longitudinal section showing a first embodiment according to the present invention.
Figure 2:
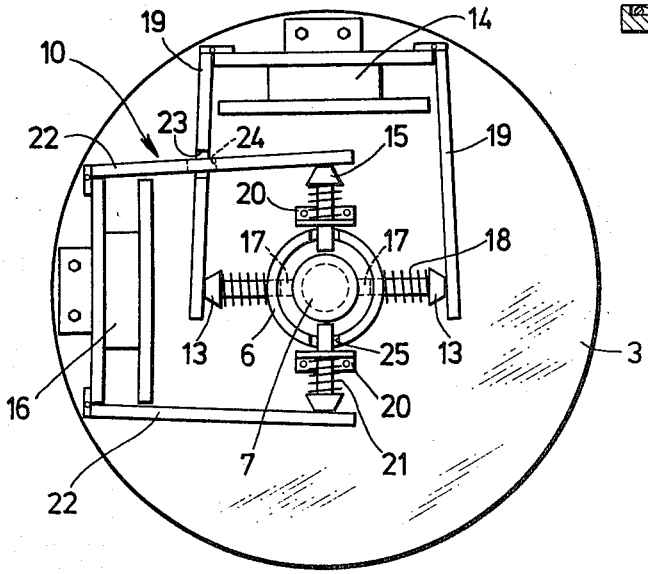
FIG. 2 is an enlarged top plan of the above.

Referring now to FIGS. 1 and 2 illustrating the first embodiment of the invention, a solenoid electromagnet generally comprises an iron casing 1 having therein an electromagnet coil 2, a fixed iron core 3 with its flange closing the upper opening of said casing 1, a movable core 4 slidably mounted within the casing 1 and at its normal position opposing the fixed core 3 at a distance *d*, a lid 5 of non-magnetic material air-tightly closing the lower opening of the casing 1, an operation sleeve 6 of non-magnetic material fixed in the movable core 4, an operation rod 7 of nonmagnetic material slidably inserted in said operation sleeve 6, and an operation rod control means 10 mounted on the fixed core 3.

About said operation rod 7 are provided plural detent projections 8 arranged at spaces equal to or slightly shorter than said distance *d* between the cores 3 and 4. The projections 8 define upwardly inclining grooves about the operation rod 7. The rod 7 is downwardly urged by a coil spring 9 fitted thereabout. The upper end of the spring 9 engages a ring 11 fixed in the upper end of the operation sleeve 6, while the lower end of the spring 9 engages a collar 12 integrally provided about the lower end of the rod 7.

Said operation rod control means 10 comprises an opposing pair of picker plugs 13 controlled by an electromagnet 14 fixed on the core 3, and an opposing pair of catch plugs 15 arranged above said plugs 13 and controlled by an electromagnet 16 fixed on the core 3.

In the upper end portion of said sleeve 6 are provided opposed radial holes 17, 17 extending through the ring 11. In the holes 17 are inserted said picker plugs 13 at their inner end portions. Each of the plugs 13 is outwardly urged by a spring 18. The head of each plug 13 abuts an iron plate 19 which is connected to the electromagnet 14 in a limited pivotal movement so as to prevent the removal of the plug 13 out of the hole 17. The height of the plate 19 is larger than the distance *d* in order to prevent disengagement of the plug 13 when the sleeve 6 moves upwardly, the details of which will be explained hereinafter.

Each of said catch plugs 15 is held by a support 20 at right angles to said picker plug 13, and is outwardly urged by a spring 21. The head of each plug 15 abuts an iron plate 22 connected to the electromagnet 16 in a limited pivotal movement so as to prevent the removal of the plug 15 out of the support 20. In the crossing portions of the pivotal plates 19 and 22 are provided notches 23 and 24 so as to engage each other.

In the upper end of the operation sleeve 6 are provided opposed pair of recesses 25, 25 so that when the sleeve 6 together with the movable core 4 rises, the plugs 15 fit in the recesses 25.

From the lower end of the movable core 4 extends an integral stem 26 which air-tightly penetrates through the lid 5 so as to serve as a guide for the core 4 during its up and down movement. To the lower end of said stem 26 is fixed a collar 27 receiving the lower end of a spring 28 downwardly urging the movable core 4. The upper end of said spring 28 engages a flange of a sleeve 29 fixed to the lower face of the lid 5. The sleeve 29 fits about the stem 26 and has a key 30 slidably received in a key groove 31 longitudinally provided along the stem 26 so as to prevent the rotation of the movable core 4 together with the operation sleeve 6 thereby assuring the fits between the recesses 25 and plugs 15.

At the periphery of the collar 27 is formed a projection 32 which is adapted to close an A-contact 33 of a limit switch at the normal position of the movable core 4 and to open a B-contact 34 at the uppermost position of the core 4.

In the lid 5 are provided a pair of channels 35 and 36, the former having therein a check valve 37, while the latter an adjustable valve 38 for the adjustment of air flow.

About the lower end of the movable core 4 is mounted a flexible seal ring 39 which is adapted to perform air-tight sealing during upward movement of the core 4 but to permit air leakage during downward movement thereof. Accordingly the velocity of the upward movement of the core 4 can be controlled by adjusting the valve 38 since the chamber below the core 4 communicates with the air through the channel 36 while the channel 37 is blocked by the check valve 37.

In the casing 1 is provided an exhaust channel 40 above the seal ring 39 at any position of the core 4. Also in the movable core 4 is provided a channel 41 communicating with the lower end of the operation sleeve 6 so as to permit the exhaust of air out of the sleeve 6 during downward movement of the operation rod 7. By suitably determining the diameter of the channel 41, the velocity of the downward movement of the operation rod 7 may be controlled.

In operation of the solenoid electromagnet of the invention, before energizing, the movable core 4 is urged by the spring 28 to the normal position shown in FIG. 1. Also the operation rod 7 is urged by the spring 9 against the bottom of the operation sleeve 6. In the condition the picker plugs 13 are in the position engageable with one of the detent projections 8.

The electromagnet coil 2, electromagnet 14 and 16 are then energized to cause the picker plugs 13 to engage corresponding detent projection of the rod 7, the catch plugs 15 to abut on the periphery of the rod 7, respectively being pressed by the pivotal plates 19 and 22, and the movable core 4 to be attracted towards the fixed core 3 by the distance *d* thereby lifting the operation rod 7 by the same distance. During the movement the heads of the picker plugs 13 slide upwardly along the inner faces of the pivotal plates 19.

The fixed core 3 is then deenergized while maintaining the energization of the electromagnets 14 and 16. As a result the movable core 4 together with the operation sleeve 6 retracts to its initial position by the action of the spring 28. At this time, though the operation rod 7 also tends downwards by the action of the spring 9, the catch plugs 15 engage the corresponding detent projection of the rod 7 pushed up by the picker plugs 13, thereby holding the rod 7 at its position. Thus one step advancement of the operation rod 7 is performed. The process is repeated to case successive advancement of the operation rod 7.

As will be understood, in the above operation, the spring 28 should have stronger restoration force than the spring 9 so as to effect returning of the movable core 4 to its initial position.

When the electromagnet coil 2 is energized intermittently under the control of a relay actuated by the contacts 33 and 34 of the limit switch which are operated by the action of the projection 32 of the collar 27 fixed to the stem 26, as described in reference to FIG. 1, the operation rod 7 will automatically advance.

Upon deenergization of the electromagnets 14 and 16, the plugs 13 and 15 are out of engagement with the detent projections by the actions of the springs 18 and 21 respectively, whereby the operation rod 7 is withdrawn to its initial position by the pull of the spring 9. The returning velocity of the operation rod 7 can be controlled by the restoration force of the spring 9 relative to the spring 28 and by the diameter of the channel 40.

As mentioned before, the velocity of the upward movement of the core 4 can be controlled by the adjustable valve 38. On the other hand, during the downward movement of the core 4, the seal ring 39 has no sealing action and at the same time the channel 37 is open, thereby enabling rapid return of the core 4 to its initial position. As a result of the interval of stoppage of the operation rod 7, i.e., returning interval of the movable core 4, is much shorter than the interval when the operation rod 7 advances by one step. Macroscopically considering, therefore, the step by step advancement of the operation rod 7 is not intermittent, but can be smooth and continuous movement.

Figure 3:
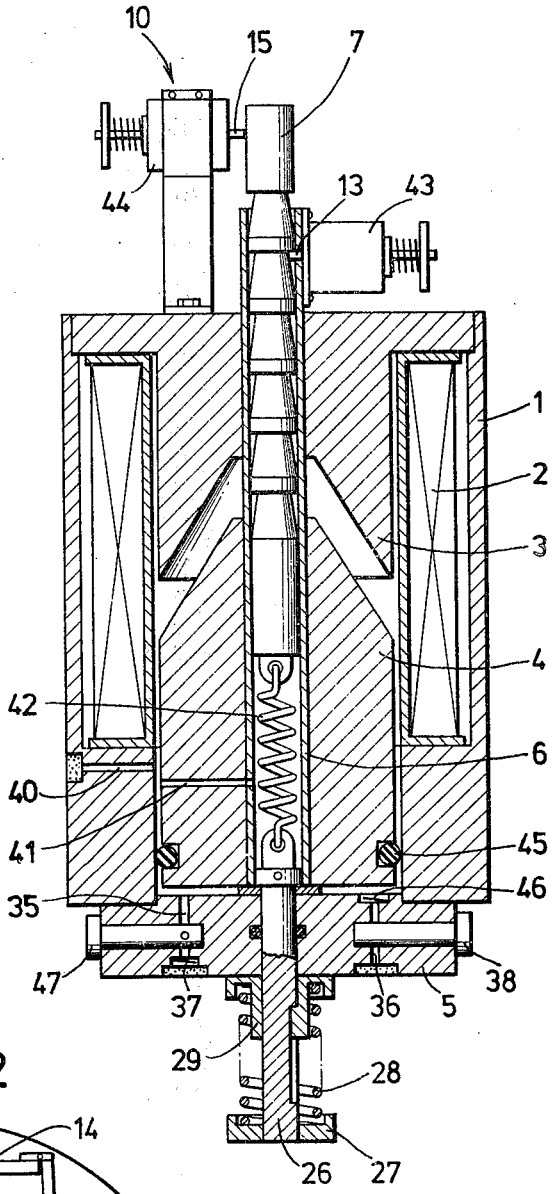
FIGS. 3 and 4 are longitudinal sections illustrating second and third embodiments respectively.

FIG. 3 shows another embodiment of the invention. In the Figure, the operation sleeve 6 fixed to the movable core 4 has upper and lower openings in the latter of which is secured the upper end portion of the stem 26. The lower end of the operation rod 7 and the upper end of the stem 26 are connected by means of a spring 42 downwardly urging said rod 7. The operation rod control means 10 includes a first solenoid electromagnet 43 fixed to the operation sleeve 6, and a second solenoid electromagnet 44 securely mounted on the fixed core 3 by means of a support, the movable core of the first electromagnet serving as the picker plug 13, while that of the second electromagnet as the catch plug 15. The movable cores of said electromagnets 43 and 44 are inwardly biased by springs so that the plugs 13 and 15 are engageable with the detent projections of the rod 7. Upon energizing the electromagnets 43 and 44, the plugs 13 and 15 are out of engagement with the detent projections of the rod 7, permitting the latter to return to its initial position.

About the movable core 4 is mounted a seal ring 45 performing the sealing in both moving directions of the core 4 (note that the seal ring 39 of FIG. 1 has one-way sealing.). In the channel 36 of the lid 5 is provided a check valve 46, and in the channel 35 is provided an adjustable valve 47 for the control of air stream. The velocities of both the upward and downward movements of the core 4 can be controlled by the adjustable valves 38 and 47.

Figure 4:
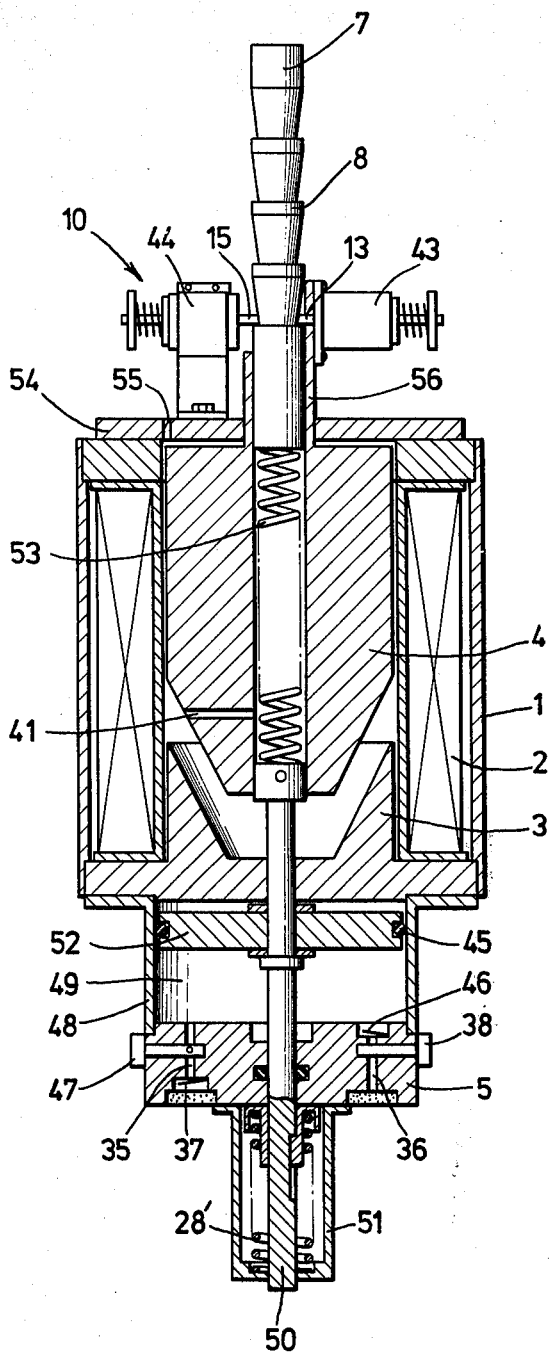

FIG. 4 shows a further embodiment of the invention. In the embodiment the operation rod 7 moves in the retractive direction. As shown, the fixed core 3 and the movable core 4 are inverted. The operation rod control means 10 is similar to that of FIG. 3.

On the fixed core 3 is securely mounted a hollow cylindrical member 48 closed by the lid 5 having the same structure as that of FIG. 3. The fixed core 3, the cylindrical member 48 and the lid 5 define a cylinder chamber 49. A stem 50 fixed to the lower end of the movable core 4 slidably extends through the fixed core 3, the lid 5 and a cup 51 secured to the lid 5. The stem 50 has a piston 52 in the cylinder chamber 49. A spring 28' upwardly biasing the stem 50 is housed in the cup 51. The operation rod 7, which is arranged reversely to FIG. 3, is slidably inserted in the movable core 4, and a spring 53 is mounted between the rod 7 and the stem 50 so as to upwardly urge the rod 7.

The upper opening of the casing 1 is closed by a lid 54 having a channel 55. An integral sleeve portion 56 of the movable core 4 fits about the operation rod 7 and slidably extends above the lid 54. To said sleeve portion 56 is fixed the solenoid electromagnet 43, while the solenoid electromagnet 44 is securely mounted on the lid 54 by means of a support so that the catch plug 15 of the magnet 44 opposes the picker plug 13 of the magnet 43. This arrangement of the operation rod control means 10 operates similarly to that of FIG. 3.

Upon energizing the coil 2, the movable core 4 is attracted towards the fixed core 3 thereby withdrawing the operation rod 7 by the engagement of the picker plug 13 with the detent projection of the rod 7. At the same time the catch plug 15 engages the succeeding detent projection, thus performing step by step retraction of the operation rod 7.

Similar to the second embodiment of FIG. 3, the velocities of upward and downward movements of the core 4 can be controlled by the adjustable valves 38 and 47.

In the above several embodiments, as will be understood, the more the operation rod 7 projects out of the casing 1 (in the case of FIG. 4, retracts into the casing 1), the larger the restoration force of the spring 9, 42 or 53 that acts on the operation rod 7, causing slower return of the movable core 4 because the restoration force of the spring 28 or 28' decreases relative to the spring 9, 42 or 53. As a result the stoppage interval of the operation rod 7 increases. Further this causes faster wearing of the spring 9, 42 or 53. It is therefore preferable to utilize the longest possible spring.

Figure 5:
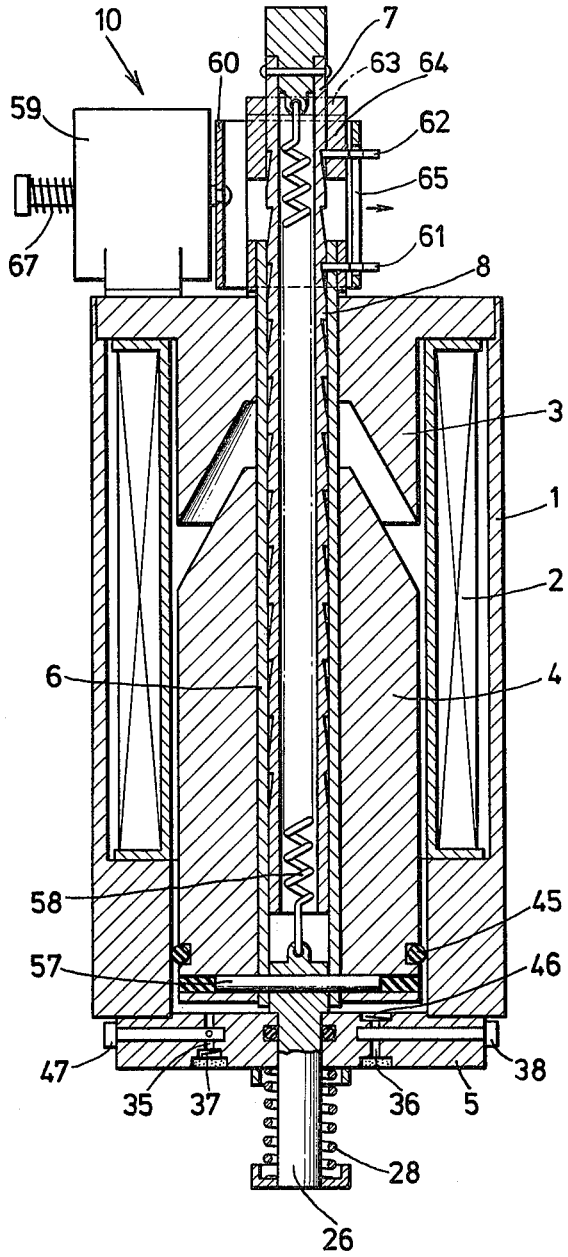
FIG. 5 is a longitudinal section showing a fourth embodiment of the invention.
Figure 6:
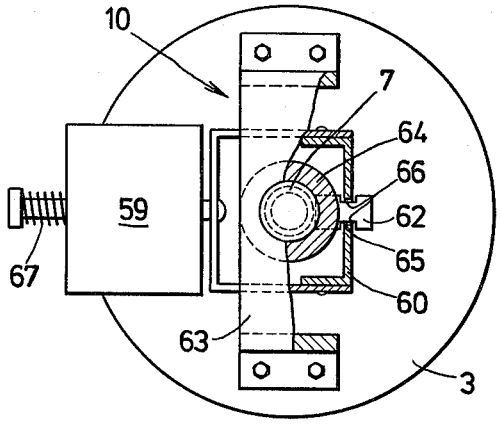
FIG. 6 is a top plan of the same.

FIGS. 5 and 6 show the improvement in view of the above. The embodiment incorporates further improvement of the operation rod control means 10. In the Figures, the hollow operation rod 7 having the detent projections 8 is inserted in the operation sleeve 6 extending through the cores 3 and 4. The operation sleeve 6 and the stem 26 are fixed together by means of a pin 57 radially extending through the core 4, sleeve 6 and stem 26. In the hollow operation rod 7 is inserted a spring 58 one end of which is connected to the upper end of the stem 26 and the other end to the upper end of the rod 7, the spring 58 urging the rod 7 downwardly. As seen, the hollow rod 7 enables the accommodation of the longer spring.

On the fixed core 3 is mounted the operation rod control means 10 comprising a solenoid electromagnet 59, and a slide box 60 connected to the moving core of the electromagnet 59 and having a picker 61 together with a catch 62. A reverse U-shaped support 63 bridged above the slide box 60 is secured to the fixed core 3. At the center of the support 63 is provided a cylindrical guide 64 downwardly extending into the slide box 60. The operation rod 7 is slidably inserted through the cylindrical guide 64.

In the end wall of the slide box 60 is provided a vertical slot 65 the sides of which slidably engage opposed notches 66 of the picker 61 and catch 62, as best seen in FIG. 6. The inner portion of the picker 61 slidably extends through the operation sleeve 6 to engage one of the detent projections 8 of the rod 7, while the inner portion of the catch 62 slidably extends through the fixed cylindrical guide 64 to project beyond the inner periphery thereof so as to be engageable with the detent projection. A spring 67 urges the movable core of the electromagnet 59 towards the position where the picker 61 and catch 62 are engageable with the detent projections of the operation rod 7. Upon energizing the electromagnet 59, the movable core thereof pushes the slide box 60 in the direction of arrow of FIG. 5 to cause the picker 61 and catch 62 to disengage from the detent projections.

In operation, upon energizing the coil 2, the movable core 4 is attracted towards the fixed core 3 to raise the operation sleeve 6. Thereupon the picker 61 engaging one of the detent projections 8 of the rod 7 and pushes up the rod while sliding along the vertical slot 65 of the box 60. Then the catch 62 having the axially fixed connection with respect to the rod 7 engages preceding one of the detent projections to hold the rod 7 at its position.

Upon deenergizing the coil 2, the movable core 4 returns to its initial position by the pull of the spring 28.

The above process is repeated to make possible advancement of the operation rod 7. In order to return the rod 7 to its initial position, the electromagnet 59 is energized, and the movable core thereof pushes the slide box 60, causing the picker 61 as well as catch 62 to disengage from the detent projections of the rod 7 which is pulled by the spring 58. Since the operation rod 7 will not return without energizing the electromagnet 59, when the electric supply is interrupted by some reason, the operation rod 7 stops at the position held by the catch 62.

As shown in FIG. 5, since the adjustable valves 38 and 47 are provided in the channels 36 and 35 respectively, the velocities of the up and down movements of the core 4 can be controlled similarly to the second embodiment of FIG. 3.

Figure 7:
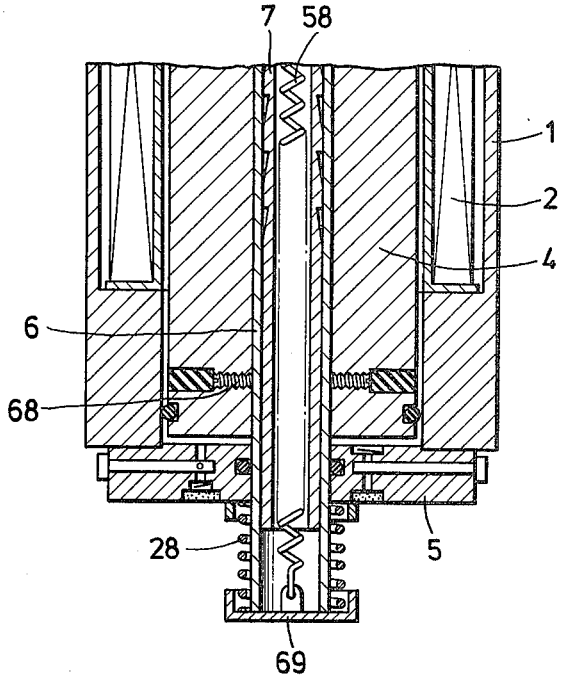
FIG. 7 is a section showing a slight modification of FIG. 5.

FIG. 7 shows a slight modification of FIG. 5. The stem 26 of FIG. 5 is eliminated. Instead, the operation sleeve 6 extends beyond the lid 5. The operation sleeve 6 is fixed to the movable core 4 by means of set screws 68. The spring 28 downwardly urging the sleeve 6 is fitted thereabout between the lid 5 and a cap 69 fixed to the lower end of the sleeve 6. The hollow operation rod 7 is inserted in this sleeve 6. The spring 58 downwardly urging the operation rod 7 is inserted therein, one end of the spring being connected to the cap 69 and the other end to the upper end of the hollow rod 7 similarly to FIG. 5. This arrangement permits accommodation of a longer spring than that of FIG. 5, thereby maintaining constant returning velocity of the movable core 4 by decreasing the extension ratio of the spring 58 in relation to the advancement of the rod 7. Also the wear of the spring is reduced.

When the load on the operation rod 7 has a restoration force enough for returning the rod 7, the spring 9, 42, 53 or 58 can be eliminated.

In the above embodiments, if a wider stroke of the operation rod is required, the axial length of the electromagnet is extended so that it can accommodate a longer operation rod having a number of detent projections. In such arrangement, the volume of the electromagnet coil 2 necessarily increases to provide larger magnetic generation and attractive force, thus resulting in bigger capacity as well as longer stroke.

If a smoother movement of the operation rod is desired, the distance between the adjacent projections of the operation rod is made shorter, and the channels 35 and 36 are eliminated so that the lid 5 air-tightly closes the lower opening of the casing 1. In this arrangement, the negative air pressure acts on the core 4 being attracted towards the fixed core 3, while the positive pressure acts on the core 4 returning to its normal position, thereby cushioning the movement at the finishing point thereof. Further at the start of the movement of the core 4, the expansion or contraction of the air accelerates the movement.

If a rapid movement of the operation rod is required, the seal ring 39 or 45 is omitted.

As described above, according to the present invention, a single stroke of the movable core 4 advances the operation rod 7 by a predetermined distance, and plural strokes of the core 4 make possible the advancement of a corresponding number of times of said distance, resulting in a far wider operative stroke than a conventional solenoid electromagnet. Moreover by counting the number of the strokes of the movable core 4, the actual width of the operative stroke of the operation rod can be obtained. Therefore the stroke width of the operation rod can be controlled as desired.

The solenoid electromagnet of the invention is simple in construction, inexpensive in cost, and low in energy consumption, as compared to a conventional air cylinder and the like. Further since the device of the invention is operated solely by the electricity, it will not be spoiled by oil and the like. By the same reason, the device has an instantaneous response, and the magnetic attraction force as well as attraction speed can be readily controlled by the adjustment of the voltage or current.

What I claim is:

1. A solenoid electromagnet comprising a casing having an electromagnet coil, a fixed core in said casing, a moving core mounted within said casing and slidable towards and away from said fixed core, a spring urging said moving core away from said fixed core, an operation rod having thereabout plural detent projections at predetermined spaces and slidably extending into said moving core, a picker means having a radially retractile and axially fixed connection with said moving core, a catch means having a radially retractile and axially fixed connection with said fixed core, said picker and catch means being engageable with said detent projections of the operation rod, and means for releasing said picker and catch means from the detent projections.

2. A solenoid electromagnet as claimed in claim 1, wherein said picker and catch means are urged by springs against said detent projections of the operation rod.

3. A solenoid electromagnet as claimed in claim 2, wherein said means for releasing the picker and catch means comprises an electromagnet the movable core of which is connected to said picker and catch means, said electromagnet being adapted to withdraw said picker and catch means when energized.

4. A solenoid electromagnet as claimed in claim 1, wherein said operation rod is hollow and a spring biasing the operation rod towards the movable core is mounted within said hollow operation rod.

5. A solenoid electromagnet as claimed in claim 1, wherein a seal ring is mounted about said movable core, said casing being closed by a lid having a pair of channels extending therethrough, adjustable means for the adjustment of air flow being provided in said channels, and a check valve in one of said channels and a reverse check valve in the other being provided.

* * * * *